US005358436A

United States Patent [19]

Soda et al.

[11] Patent Number: 5,358,436

[45] Date of Patent: Oct. 25, 1994

[54] TILT CYLINDER DEVICE FOR OUTBOARD ENGINE

[75] Inventors: Chiharu Soda, Saitama; Kimiaki Ueno, Tochigi, both of Japan

[73] Assignee: Honda Giken Kogyo Kabushiki Kaisha, Tokyo, Japan

[21] Appl. No.: 163,579

[22] Filed: Dec. 6, 1993

Related U.S. Application Data

[63] Continuation of Ser. No. 690,647, Apr. 24, 1991, abandoned.

[30] Foreign Application Priority Data

| | | | |
|---|---|---|---|
| Apr. 24, 1990 | [JP] | Japan | 2-107835 |
| Apr. 24, 1990 | [JP] | Japan | 2-107836 |
| Apr. 24, 1990 | [JP] | Japan | 2-107837 |

[51] Int. Cl.[5] ..... B63H 21/26

[52] U.S. Cl. ..... 440/61; 440/55

[58] Field of Search ..... 440/55, 56, 61; 92/5 R; 248/642

[56] References Cited

U.S. PATENT DOCUMENTS

| | | | |
|---|---|---|---|
| 4,687,449 | 8/1987 | Fenrich | 440/61 |
| 4,784,625 | 11/1988 | Nakahama | 440/61 |
| 5,000,707 | 3/1991 | Saitoh et al. | 440/61 |
| 5,030,148 | 7/1991 | Funami et al. | 440/61 |
| 5,032,094 | 7/1991 | Katogi | 440/61 |

FOREIGN PATENT DOCUMENTS

| | | | |
|---|---|---|---|
| 59-5480 | 2/1984 | Japan . | |
| 60-1097 | 1/1985 | Japan . | |
| 234095 | 11/1985 | Japan | 440/61 |
| 251295 | 11/1987 | Japan | 440/61 |
| 14997 | 1/1990 | Japan | 440/55 |

*Primary Examiner*—Michael S. Huppert
*Assistant Examiner*—Thomas J. Brahan
*Attorney, Agent, or Firm*—Irving M. Weiner; Joseph P. Carrier; Pamela S. Burt

[57] ABSTRACT

An outboard engine assembly has a stern bracket adapted to be fixed to a boat body, a swivel case vertically swingably supported on the stern bracket, an engine body laterally swingably supported on the swivel case, and a tilt cylinder device disposed between the stern bracket and the swivel case. The outboard engine assembly has a corrosion-resistant mechanism comprising a first anodic metal element attached to a lower portion of the engine body, a second anodic metal element attached to a submersible portion of the stern bracket, a first electric connecting circuit by which the first and second anodic metal elements are electrically connected to each other, and a second electric connecting circuit branched from the first electric connecting circuit and connecting the first electric connecting circuit to the tilt cylinder device. The tilt cylinder device comprises a cylinder unit actuatable by a pressurized fluid supplied from a pressure fluid supply. The cylinder unit is disposed substantially centrally in a planar region defined by the swivel case and lying parallel to a tilt shaft pivotally connecting the case and the swivel bracket. The pressure fluid supply is divided and disposed on both sides of the cylinder unit. The tilt cylinder device comprises a cylinder coupled to the swivel case, a piston rod coupled to the stern bracket. The outboard engine assembly has a damage preventing mechanism for allowing relative movement of the cylinder and the piston rod when the engine body is subjected to an excessive external force.

14 Claims, 11 Drawing Sheets

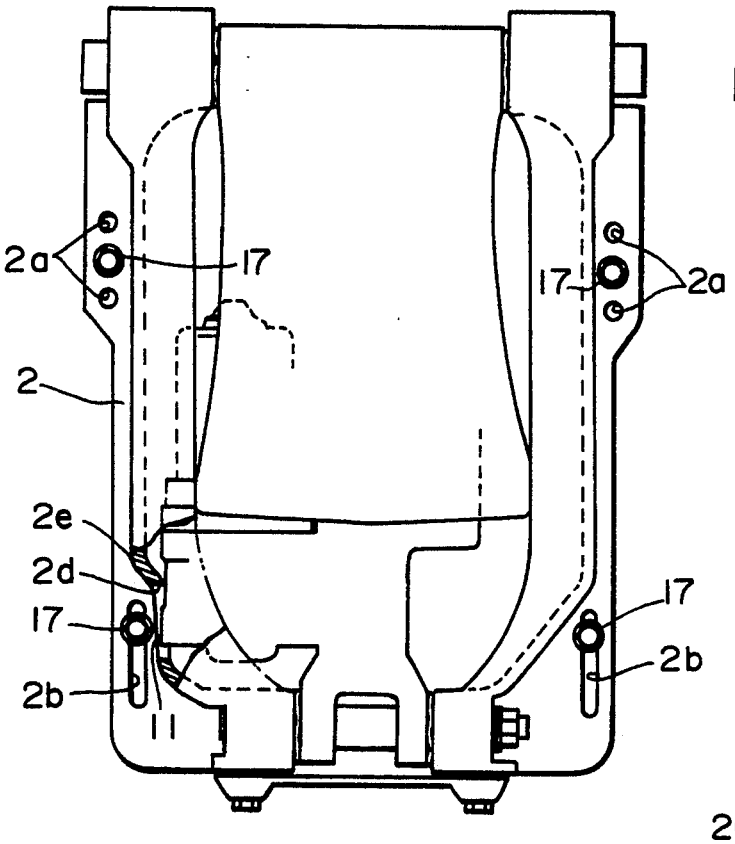
FIG. 6
FIG. 7
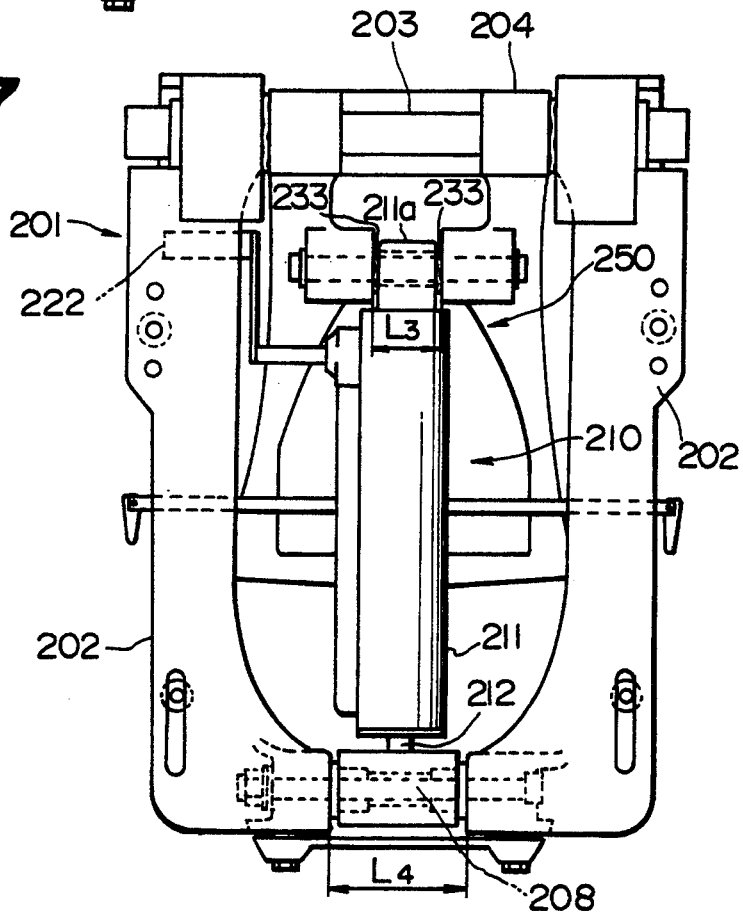

TILT CYLINDER DEVICE FOR OUTBOARD ENGINE

This is a continuation of application Ser. No. 07/690,647, filed Apr. 24, 1991 now abandoned.

BACKGROUND OF THE INVENTION

1. Field of the Invention

The present invention relates to a tilt cylinder device for an outboard engine for use on a small boat.

2. Description of the Relevant Art

FIG. 15 of the accompanying drawings shows, in side elevation, an outboard engine for use on a small boat, as disclosed in Japanese Laid-Open Patent Publication No. 60-1097. A pair of laterally spaced stern brackets 502 is fixedly mounted on the stern B of a boat, and a swivel case 504 is supported between the stern brackets 502 by a horizontal pin 503. An outboard engine assembly 501 has an engine body 507 supported by rubber mounts 506*a*, 506*b* on a vertical swivel shaft 505 extending through and mounted on the swivel case 504. The swivel case 504 is supported by a tilt cylinder device 510 whose lower end is coupled to the stern brackets 502.

The outboard engine assembly 501 has an engine (not shown) in its upper portion and a propeller 520 on its lower end.

The cylinder device 510 includes a hydraulic cylinder. The engine body 507 is turned upwardly about the pin 503 to the imaginary-line position (FIG. 16) when the boat sails in the shallows or to the solid-line position (FIG. 16) when the boat is grounded or put ashore. The engine body 507 remains held in the elevated position by the tilt cylinder device 510.

The tilt cylinder device 510 is disposed between the stern brackets 502 and the swivel case 504. If the tilt cylinder device 510 is of a large size, then the stern brackets 502 which surround the tilt cylinder device 510 are naturally large in size. It has been desired to reduce the size of the tilt cylinder device and hence the size of the stern brackets.

In the conventional mechanism disclosed in Japanese Laid-Open Patent Publication No. 60-1097, the tilt cylinder device 510 has a cylinder unit and a pressure fluid supply which are juxtaposed within the outer profile of the swivel case, with the longitudinal axis of the cylinder unit being displaced off the longitudinal axis of the swivel case.

Because the cylinder unit and the pressure fluid supply are positioned within the outer profile of the swivel case, any necessary fluid piping may be relatively short. However, the overall configuration of the swivel case is asymmetric since the longitudinal axis of the cylinder unit is positioned out of alignment with the longitudinal axis of the swivel case. As a result, the outboard engine assembly is not well balanced in shape and weight, tending to lower the structural strength of the swivel case. If the mechanical strength of the swivel case is increased, then the weight of the outboard engine assembly is also increased.

The outboard engine assembly that is made of aluminum or aluminum alloy is susceptible to electrolytic corrosion due to continuous contact with seawater. One corrosion-resistant mechanism comprises two anodic metal elements positioned near the propelling screw and at the lower ends of the stern brackets. The anodic metal elements are caused to corrode sooner than the outboard engine body, thereby protecting the outboard engine assembly from corrosion. A relatively large anodic metal element may be attached to the lower ends of the stern brackets.

If a corrosion-resistant mechanism of the above structure were incorporated in the arrangement disclosed in the above publication, then the outboard engine body, the swivel shaft, the swivel case, and the stern brackets would be successively electrically connected by leads. The out-board engine body would be electrically connected to the large-size anodic metal element at the lower ends of the stern brackets by the leads, so that the outboard engine body would be prevented from being corroded over a long period of time.

Since the leads would be interconnected between those members which are relatively movable, they would be exposed and tend to be damaged, making the outboard engine assembly open to attack by corrosion. The exposed leads would easily collect seaweed and dirt, and become unsightly in appearance. In addition, it would be tedious and time-consuming to connect the leads.

Japanese Patent Publication No. 59-5480 shows an outboard engine for small boats. If a lower portion of the disclosed outboard engine hits an underwater obstacle while the boat is sailing, a relief valve in a piston in a tilt cylinder is actuated to move the piston for dampening shocks, so that the outboard engine is prevented from being damaged.

Boats may move forwardly or rearwardly while they are sailing in the shallows. When a boat moves backwards, the lower portion of the outboard engine may be subjected to unexpected forces by an obstacle. The outboard engine disclosed in Japanese Patent Publication No. 59-5480 is, however, not structured for protection against shocks developed by external forces applied when the boat sails backwards.

The present invention has been made in an effort to solve the aforesaid problems and disadvantages of the conventional outboard engines for small boats.

SUMMARY OF THE INVENTION

It is an object of the present invention to provide a tilt cylinder device for an outboard engine for use on a small boat, the tilt cylinder device being relatively small in size while keeping the outboard engine well balanced and minimizing an increase in the mechanical strength of a swivel case.

Another object of the present invention is to provide a corrosion-resistant mechanism for highly reliably preventing an outboard engine from being corroded, the corrosion-resistant mechanism being sightly in appearance and easily assembled.

Still another object of the present invention is to provide an outboard engine assembly having a tilt cylinder device which is effective to prevent the outboard engine from being damaged by external forces that may be applied when a boat, which incorporates the outboard engine assembly, moves forwardly or rearwardly.

According to the present invention, there is provided a corrosion-resistant mechanism in an outboard engine assembly having a stern bracket adapted to be fixed to a boat body, a swivel case vertically swingably supported on the stern bracket, an engine body laterally swingably supported on the swivel case, and a tilt cylinder device disposed between the stern bracket and the swivel case. The corrosion-resistant mechanism comprises a first anodic metal element attached to a lower portion of the engine body, a second anodic metal element attached to a submersible portion of the stern bracket, a first electric connecting circuit by which the first and second anodic metal elements are electrically connected to each other, and a second electric connecting circuit branched from the first electric connecting circuit and connecting the first electric connecting circuit to the tilt cylinder device.

According to the present invention, there is also provided a tilt device in a boat propelling apparatus having a stern bracket adapted to be fixed to a boat body, a swivel case vertically swingably supported on the stern bracket by a tilt shaft, a propulsion unit mounted on the swivel case, the tilt device being disposed between the swivel case and the stern bracket, the tilt device comprising a pressure fluid supply for supplying a pressurized fluid, and a cylinder unit actuatable by the pressurized fluid supplied from the pressure fluid supply, the cylinder unit being disposed substantially centrally in a planar region defined by the swivel case and lying parallel to the tilt shaft, the pressure fluid supply being divided and disposed on both sides of the cylinder unit.

According to the present invention, there is further provided an outboard engine assembly comprising a stern bracket adapted to be fixed to a boat body, a swivel case, an engine body laterally swingably supported on the swivel case, and a tilt cylinder device disposed between the stern bracket and the swivel case, the tilt cylinder device comprising a hydraulic cylinder disposed substantially centrally of the stern bracket in a transverse direction of the boat body, the hydraulic cylinder having a vertically extending cylinder case, a motor and a pump which are disposed on one side of the hydraulic cylinder, and a reservoir disposed on the other side of the hydraulic cylinder, the motor, the pump, and the reservoir being positioned lower than an upper surface of the cylinder case and housed in the stern bracket, the pump having a pump case, the tilt cylinder device also including a hydraulic manual relief valve mounted on the pump case, the stern bracket having a window for manually operating the manual relief valve therethrough.

According to the present invention, there is further provided a tilt cylinder device in an outboard engine assembly having a stern bracket adapted to be fixed to a boat body, a swivel case vertically swingably supported on the stern bracket, and an engine body laterally swingably supported on the swivel case, the tilt cylinder device being disposed between the stern bracket and the swivel case, the tilt cylinder device comprising a cylinder disposed substantially vertically and having an upper portion coupled to the swivel case, a piston rod extending downwardly from the cylinder and having a lower end coupled to the stern bracket, a first piston coupled to the piston rod in the cylinder and fitted in the cylinder, a free piston fitted in the cylinder and disposed upwardly of the first piston, a gas chamber defined above the free piston above the cylinder and filled with a gas under a pressure higher than the atmospheric pressure. The cylinder has a first chamber defined between the first piston and the free piston, a second chamber defined below the first piston, and a third chamber defined above the free piston. The first piston has a unidirectional valve for allowing working oil to flow from the first chamber into the second chamber, and a first pressure relief valve for allowing working oil to flow from the second chamber into the first chamber only when the pressure of working oil in the second chamber is higher than the pressure of working oil in the first chamber by a predetermined level. The cylinder has a communication passage through which the third chamber and the second chamber communicate with each other, the communication passage having a second pressure relief valve for allowing working oil to flow from the third chamber into the second chamber only when the pressure of working oil in the third chamber is higher than the pressure of working oil in the second chamber by a predetermined level, and a mechanism for manually opening and closing the second pressure relief valve.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 6 is an elevational view as viewed in the direction indicated by the arrow 6 in FIG. 3;

FIG. 7 is an elevational view of an outboard engine assembly according to a second embodiment of the present invention, showing a tilt cylinder device and stern brackets as viewed from a boat on which the outboard engine assembly is mounted;

DETAILED DESCRIPTION OF THE PREFERRED EMBODIMENTS

FIGS. 1 through 6 show an outboard engine assembly 1 according to a first embodiment of the present invention, the outboard engine assembly 1 being mounted on a small boat. The outboard engine assembly 1, and its brackets and other associated members are made of an aluminum alloy.

Figure 1:
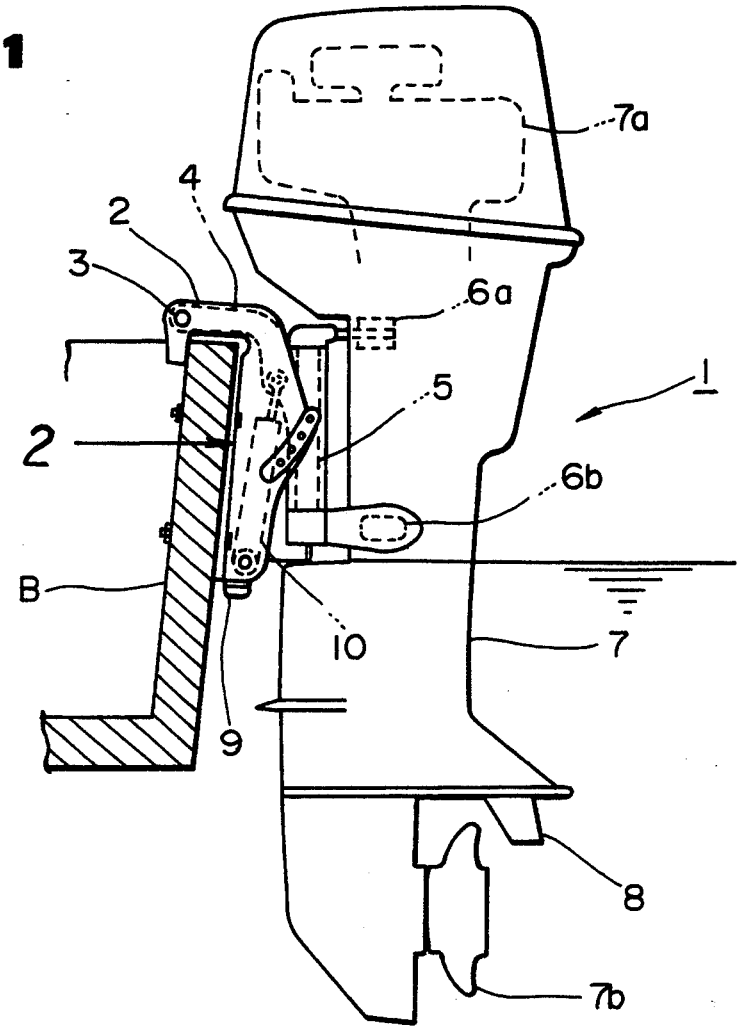
FIG. 1 is a schematic side elevational view of an outboard engine assembly according to a first embodiment of the present invention.
Figure 2:
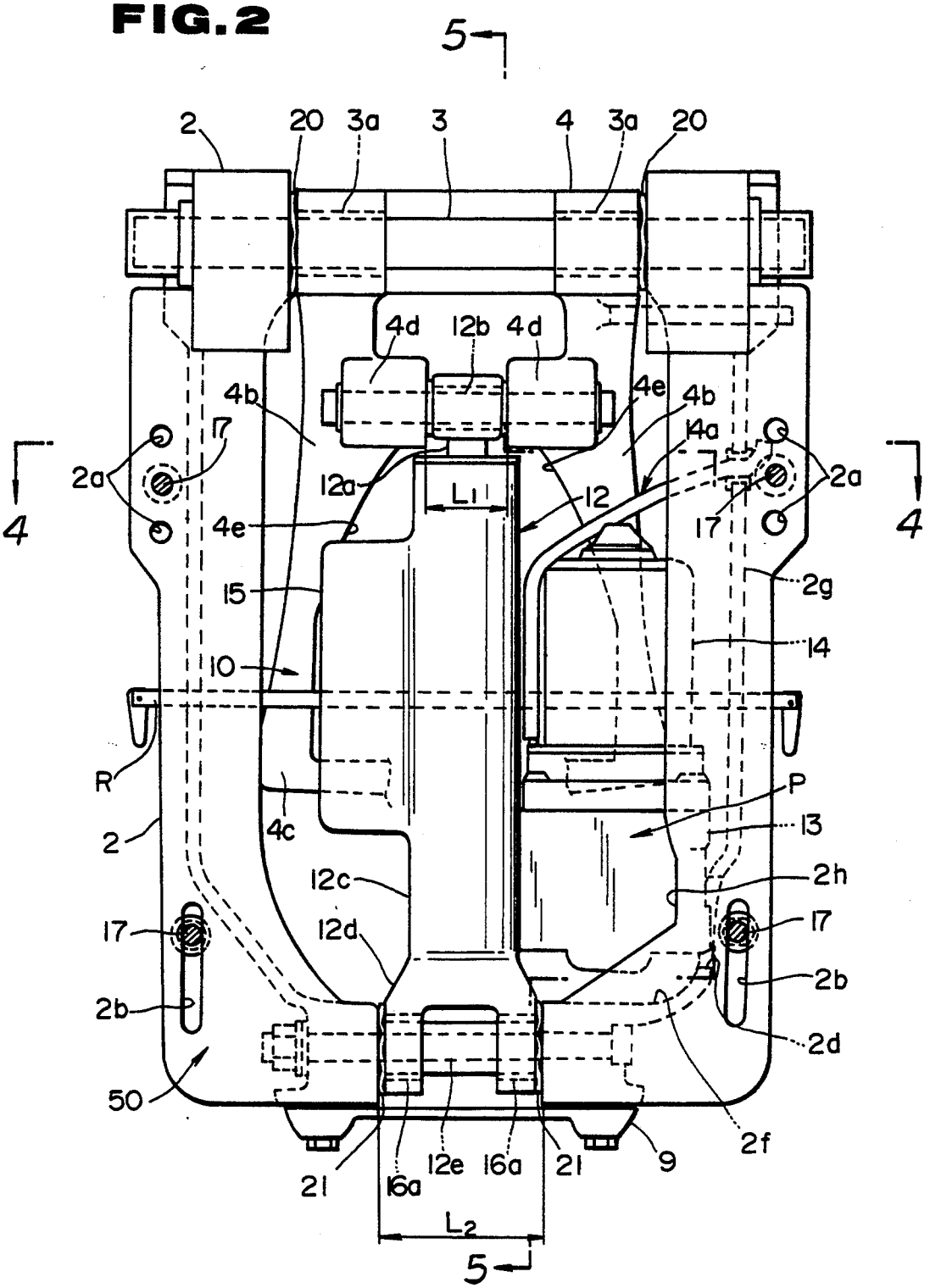
FIG. 2 is an elevational view as viewed in the direction indicated by the arrow 2 in FIG. 1.

As shown in FIGS. 1 and 2, a pair of laterally spaced stern brackets 2 is fixedly mounted on the stern B of the boat, and a swivel shaft 5 vertically extends through a tubular member 4a (see FIG. 4) on a rear portion of a swivel case 4 which is vertically swingably supported between the stern brackets 2 by a horizontal pin 3. The swivel case 4 has a pair of wings 4*b* spreading laterally, and a pair of abutments 4*c* on the lower distal ends of the wings 4*b*, the abutments 4*c* being held in abutment against a rod R. The outboard engine assembly 1 has an engine body 7 supported laterally swingably on the swivel shaft 5 by rubber mounts 6*a*, 6*b*. A hydraulically operated tilt cylinder device 10 is interposed between the stern brackets 2 and the swivel case 4. The horizontal pin 3 serves as a tilt shaft about which the outboard engine body 7 is tiltable by the tilt cylinder device 10.

The outboard engine assembly 1 includes an engine 7*a* in its upper portion and a propeller 7*b* on its lower end. A first anodic metal element 8 is positioned immediately above the propeller 7*b*. The first anodic metal element 8, which doubles as a trim tab, has a streamlined cross-sectional shape and a relatively small volume.

A second anodic metal element 9 is fastened to the lower surfaces of the stern brackets 2 by bolts. The lower surfaces of the stern brackets 2 to which the second anodic metal element 9 is bolted are usually submerged in water.

As shown in FIG. 2, the stern brackets 2 are jointed substantially in the shape of a U as viewed from the stern B. The stern brackets 2 have upper bolt holes 2*a* and lower slots 2*b* through which they are fastened to the stern B by bolts 17. The horizontal pin 3 extends through an upper portion of the swivel case 4 between upper portions of the stern brackets 2.

Resin bushings 3*a* are fitted over the horizontal pin 3 within the swivel case 4, so that the pin 3 and the swivel case 4 are electrically insulated from each other. Wavy washers 20, which have corrugated surfaces and are made of a springy electrically conductive material, are interposed between the stern brackets 2 and the swivel case 4, thereby holding the stern brackets 2 and the swivel case 4 electrically connected to each other.

The tilt cylinder device 10 has a hydraulic cylinder 12 which comprises a piston rod 12*a* whose upper end is relatively angularly movably coupled by a pin 12*b* to a substantially central portion of the swivel case 4 in the transverse direction of the boat, and a cylinder case 12*c* whose lower end 12*d* is relatively angularly movably coupled by a pin 12*e* to the central portion of the swivel case 4. A pump 13 and an electric motor 14 are disposed on one side (righthand side in FIG. 2) of the hydraulic cylinder 12, and a reservoir 15 is disposed on the other side (lefthand side in FIG. 2) of the hydraulic cylinder 12. The pump 13 and the motor 14 are coupled to a lower portion of the cylinder 12, and the reservoir 15 is formed on an upper portion of the cylinder 12. The pump 13, the motor 14, and the reservoir 15 jointly serve as a pressure fluid supply P. The electric motor 14 is supplied with an electric current from a battery (not shown) on the boat through a cable 14*a*.

The cylinder case 12*c* is electrically insulated from the stern brackets 2 by resin bushings 16*a* that are fitted over the pin 12*e* within the lower portion 12*d* of the cylinder case 12*c*. However, the lower portion 12*d* of the cylinder case 12*c* is electrically connected to the stern brackets 2 by wavy washers 21, which are identical to the wavy washers 20, interposed between the lower portion 12*d* and the stern brackets 2.

The pin 12*b* is supported by pin bearings 4*d* of the swivel case 4 which are spaced from each other by a distance L1. The pin 12*e* is supported by lower portions of the stern brackets 2 which are spaced from each other by a distance L2.

Figure 3:
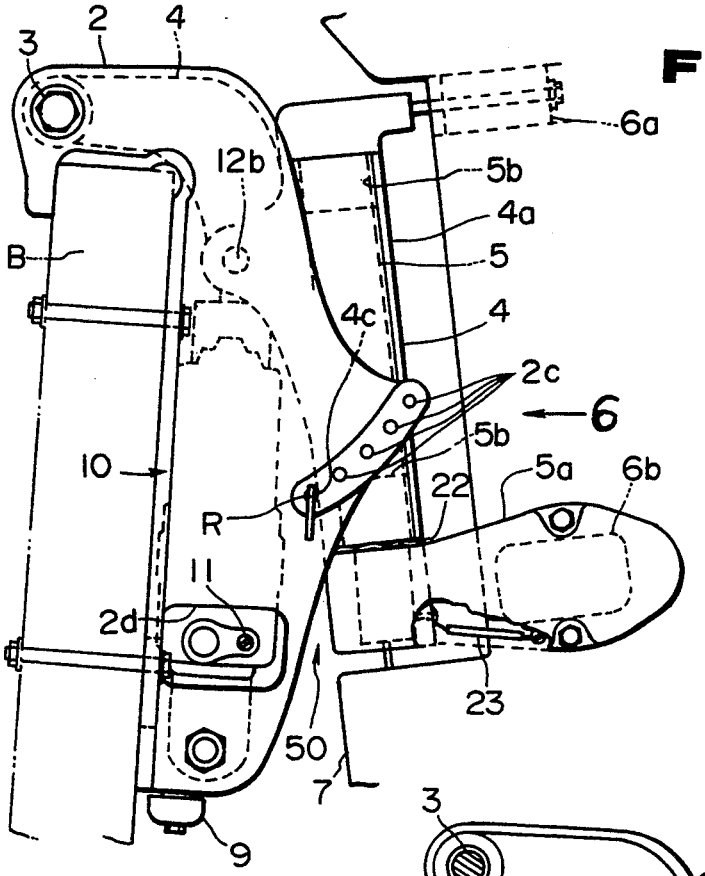
FIG. 3 is an enlarged fragmentary side elevational view of a portion of the outboard engine assembly shown in FIG. 1.

As shown in FIG. 3, the stern brackets 2 have respective arrays of rod insertion holes 2*c* defined in rear portions thereof. The rod R is removably inserted in a selected pair of the rod insertion holes 2*c*. The rod R serves to transmit propulsive forces which are applied leftwardly by the outboard engine body 7, to the stern brackets 2. The rod R can be adjusted in position with respect to the stern brackets 2 by suitably selecting the rod insertion holes 2*c*. One of the stern brackets 2 has a small rectangular opening or window 2*d* through which a manual relief valve 11 (described later) can directly be accessed.

As shown in FIG. 2, the wings 4*b* of the swivel case 4 have arcuate edges 4*e* which are spread outwardly to the pin bearings 4*d* toward the abutments 4*c* in order to allow a portion of the pressure fluid supply P to project laterally outwardly.

One of the stern brackets 2 has a recess 2*f* defined in an inner lower portion thereof, the recess 2*f* receiving a portion of the pump 13. The small window 2*d* for providing access to the manual relief valve 11 is defined in the bracket side which defines the recess 2*f*. The recess 2*f* and the small window 2*d* thus defined permit the stern brackets 2 to be spaced closely from each other, making the entire arrangement shown in FIG. 2 relatively compact. The recess 2*f* is contiguous to a wall 2*g* which is spaced from the bolt holes 2*a* in an upper portion of the stern bracket 2, by a suitable clearance that is necessary when the stern bracket 2 is fastened to the stern B by the bolts 17. The other stern bracket 2 also has a wall suitably spaced from the bolt holes 2*a*. The stern bracket 2 which has the recess 2*f* and the small window 2*d* also has a recess 2*h* defined in a lower portion thereof for avoiding physical interference with the pressure fluid supply P.

As shown in FIG. 3, the outboard engine body 7 which has the first anodic metal element 8 on its lower portion is supported on an arm 5*a* on the swivel shaft 5 by the rubber mount 6*b*, and is electrically insulated from the swivel shaft 5 by the rubber mounts 6*a*, 6*b*. However, the outboard engine body 7 is actually electrically connected to the swivel shaft 5 by a single lead 23 which extends behind and is concealed by the arm 5*a*.

The swivel shaft 5 is mainly made of an iron-base metal, and is splined to the arm 5*a* so that the swivel shaft 5 and the arm 5*a* are electrically connected to each other. The swivel case 4 is electrically insulated from the swivel shaft 5 and the arm 5*a* by a resin retainer 5*b* fitted over the swivel shaft 5 in the tubular member 4*a*. However, the swivel shaft 5 and the rear tubular member 4*a* are actually electrically connected to each other by a wavy washer 22 which is identical to the wavy washers 20, 21.

A corrosion-resistant mechanism 50 of the outboard engine assembly 1 will be described below.

As shown in FIGS. 1 through 3, the first anodic metal element 8 is electrically coupled to the second anodic metal element 9 through a first electric connecting circuit which comprises the outboard engine body 7, the lead 23, the swivel shaft 5, the wavy washer 22, the swivel case 4, the wavy washers 20 (FIG. 2), and the stern brackets 2.

In FIG. 2, the cylinder case 12*c* of the tilt cylinder device 10 is electrically connected to the stern brackets 2 of the first electric connecting circuit through a second electric connector circuit which comprises the wavy washers 21.

Figure 4:
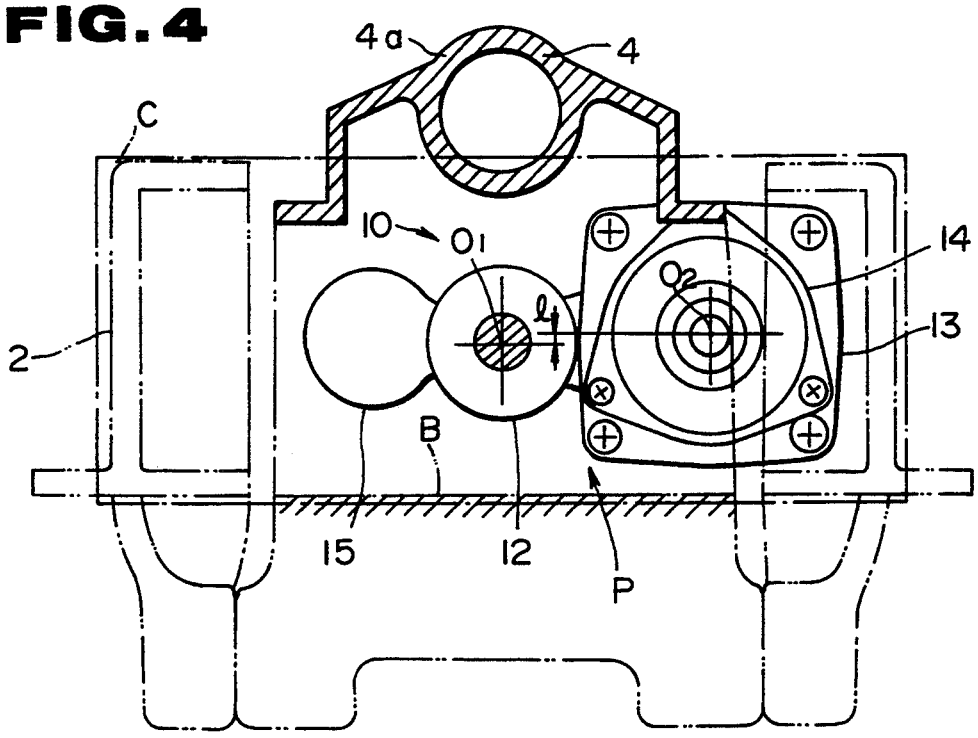
FIG. 4 is a cross-sectional view taken along line 4—4 of FIG. 2.

As illustrated in FIG. 4, the motor 14 has a center $O_2$ spaced a distance l from the center $O_1$ of the hydraulic cylinder 12 when viewed in plan, and the motor 14 and the pump 13 which have relatively large profiles are spaced from the stern B. Thus at least a portion of the pressure fluid supply is displaced with respect to the cylinder unit in a longitudinal direction of the boat body. The hydraulic cylinder 12 and the reservoir 15 are disposed closely to the stern B. The tilt cylinder device 10 is disposed within an outer profile C established jointly by the stern brackets 2. The center $O_1$ of the cylinder 12 is positioned substantially centrally in the region C.

Figure 5:
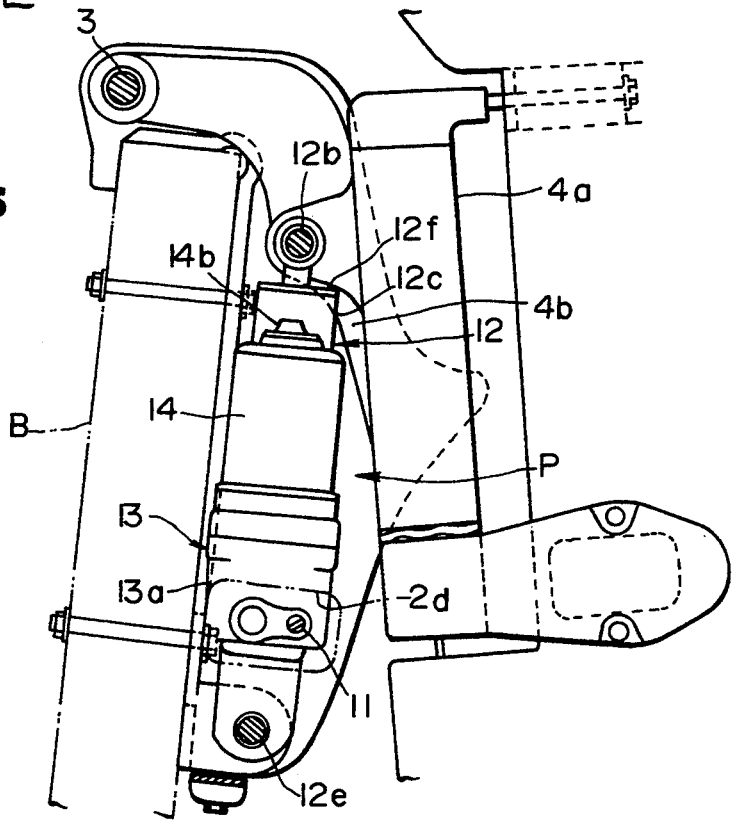
FIG. 5 is a cross-sectional view taken along line 5—5 of FIG. 2.

As shown in FIG. 5, the pump 13 has a pump case 13*a* with the manual relief valve 11 mounted on one side thereof. The motor 14 which is placed on the upper end of the pump 13 has an upper end 14*b* positioned lower than an upper surface 12*f* of the cylinder case 12*c* of the hydraulic cylinder 12. Therefore, the pressure fluid supply P is held out of physical interference with the pins 12*b*, 12*e*.

The outboard engine assembly 1 is installed on the stern B of the boat as shown in FIG. 3. While the boat is being propelled in water, reactive propulsive forces of the outboard engine body 7 act on the pin 12*b* and the elongate rod R, and are transmitted to the stern B through the stern brackets 2.

Figure 16:
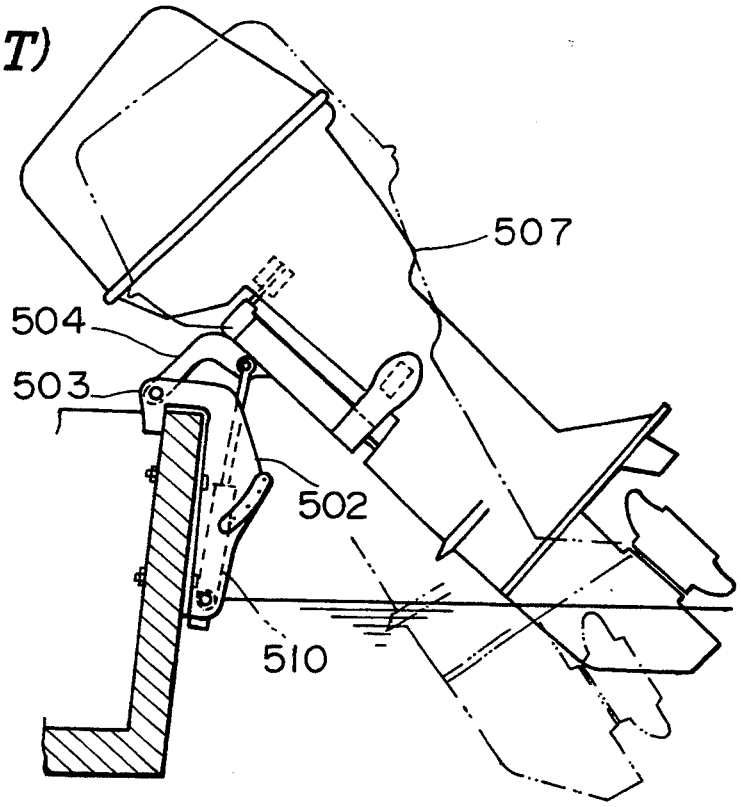
FIG.16 (PRIOR ART)

When the boat is to sail in the shallows, the motor 14 is energized by the battery on the boat through a switch (not shown) to cause the pump 13 to generate a hydraulic pressure which elevates the piston rod 12*a* of the hydraulic cylinder 12, thus lifting the pin 12*b*. The swivel case 4 is now turned counterclockwise (FIG. 3) about the horizontal pin 3 to the position which is the same as shown by imaginary lines in FIG. 16.

The internal space in the cylinder 12 as it is expanded when the piston rod 12*a* is elevated is supplied with additional pressure fluid from the reservoir 15.

The slot 2*b* which is shown on the lefthand side in FIG. 6 is located closely, in its greater part, to the small window 2*d*. The transverse dimension of the stern brackets 2 as they are viewed from behind is relatively small. This dimensional reduction is achieved partly by a rib 2*e* of one of the stern brackets 2 which is bent toward the manual relief valve 11 that is partly disposed in the small window 2*d*.

When the motor 14 and the pump 13 are reversed in operation, the swivel case 4 is lowered into the position shown in FIG. 3.

As described above, the outboard engine body 7, which is a relatively heavy object, can easily be vertically adjusted in position by the tilt cylinder device 10.

If the hydraulic cylinder 12 is locked due to a hydraulic or electric failure of the outboard engine assembly 1, then the manual relief valve 11 may be manually opened by a suitable tool such as a screwdriver through the small window 2*d* until the hydraulic cylinder 12 is unlocked.

With the arrangement shown in FIGS. 1 through 6, the size of the tilt cylinder device 10 may be reduced while keeping the outboard engine assembly 1 well balanced as a whole, and minimizing an increase in the mechanical strength of the swivel case 4. The hydraulic cylinder device 10 is disposed vertically substantially between the stern brackets 2. The motor 14 and the pump 13 are disposed on one side of the cylinder 12, whereas the reservoir 15 is disposed on the other side of the cylinder 12; while additionally the motor 14, the pump 13, and the reservoir 15 are compactly disposed below the upper surface 12*f* of the hydraulic cylinder 12. In addition, the manual relief valve 11 on the pump case 13*a* and the small opening 2*d* of one stern bracket 2 are positioned closely to each other. Accordingly, the stern brackets 2 may be rendered compact, making the outboard engine assembly 1 small in size.

The pressure fluid supply P of the tilt cylinder device 10 is divided and positioned on both sides of the cylinder 12. Thus, the center $O_1$ of the cylinder 12 may be disposed substantially centrally in the horizontal region of the swivel case 4. Accordingly, the swivel case 4 may be compact and of the same rigidity as that of the conventional swivel cases.

As shown in FIG. 4, since at least one side of the swivel case 4 is open, the swivel case 4 is held out of physical interference with the pressure fluid supply P. At least a portion of the pressure fluid supply P is accommodated between substantially channel-shaped configurations of the stern brackets 2 as viewed in plan, i.e., the recess 2*f* (FIG. 2) is defined in one of the stern brackets 2 and accommodates therein a portion of the pressure fluid supply P. Therefore, while maintaining clearances, which are necessary to attach the stern brackets 2 to the stern B, near the bolt holes 2*a* of the stern brackets 2, the distance between the stern brackets 2 may be reduced, and still held out of physical interference with the pressure fluid supply P.

Since one of the stern brackets 2 has the recess 2*h* defined in its lower portion, the stern bracket 2 is also held out of physical interference with the pressure fluid supply P while still providing a sufficient attachment surface around the slot 2*b* near the recess 2*h*.

The wavy washers 20, 21, 22 provide electric conductors for the corrosion-resistant mechanism 50 without employing almost any leads. The only lead 23 that is used is covered with the arm 5*a* extending from the swivel shaft 5.

Inasmuch as the wavy washers 21 are disposed between the tilt cylinder device 10 and the stern brackets 2, the second electric connecting circuit connected to the tilt cylinder device 10 is easily constructed of the wavy washers 21. As a consequence, the outboard engine assembly 1 is protected against corrosion highly reliably. Thus the corrosion-resistant mechanism 50 is sightly in appearance, and can easily be assembled.

Figure 8:
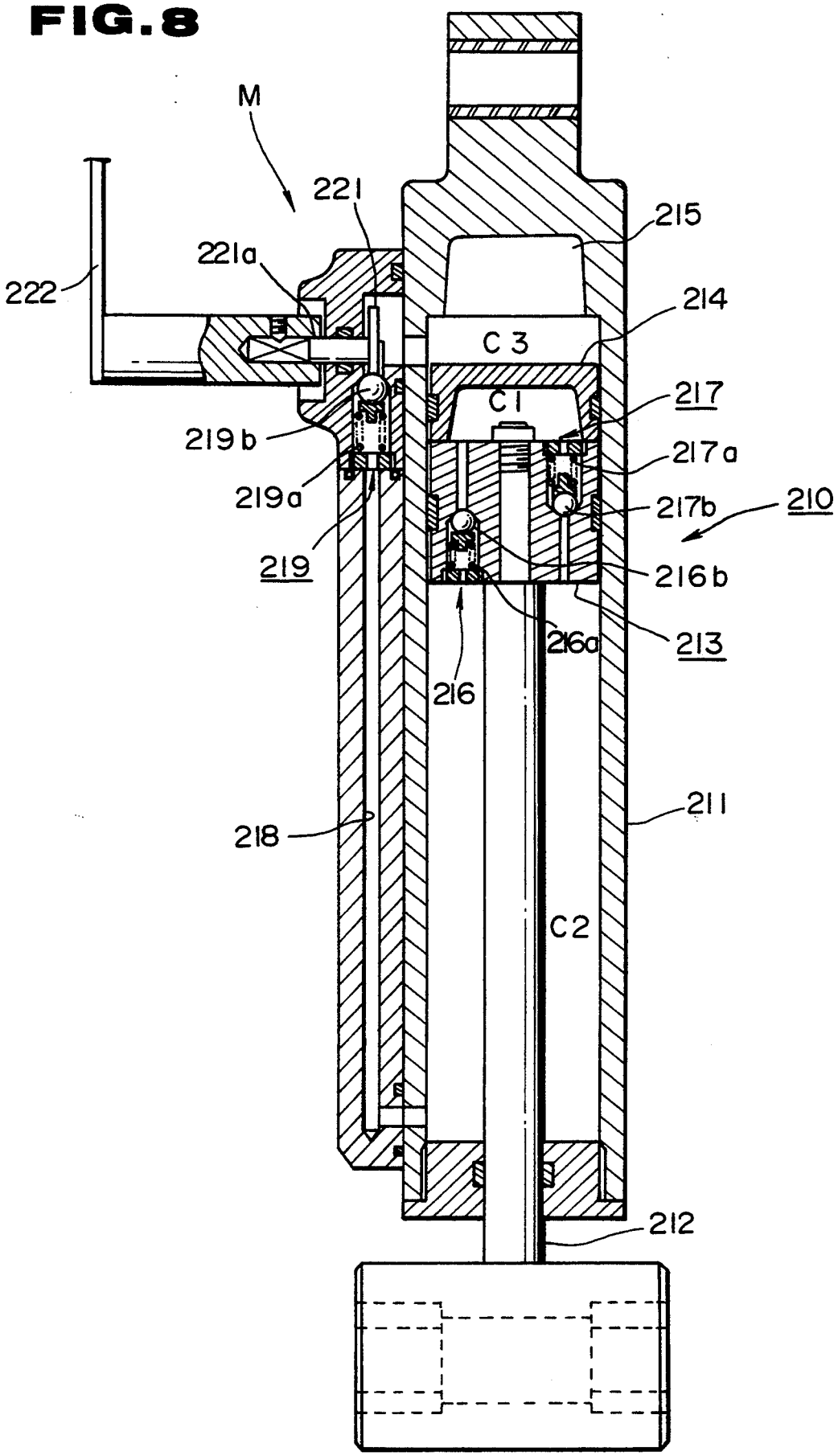
FIG. 8 is a cross-sectional view of the tilt cylinder device shown in FIG. 7.

FIGS. 7 through 12B show an outboard engine assembly 201 according to a second embodiment of the present invention. The outboard engine assembly 201 according to the second embodiment has a tilt cylinder device 210 which includes a hydropneumatic cylinder 211 having a piston rod 212 extending downwardly, as shown in FIG. 8.

As shown in FIG. 7, a swivel case 204 is supported on upper portions of stern brackets 202 by a horizontal pin 203, and the cylinder 211 has an upper end 211*a* coupled to the swivel case 204 by a pin (unnumbered). The piston rod 212 extending downwardly in the cylinder 211 has a lower distal end which is coupled to lower portions of the stern brackets 202 by a pin 208.

A corrosion-resistant mechanism 250 of the outboard engine assembly 201 differs from the corrosion-resistant mechanism 50 according to the first embodiment in that the upper end 211*a* of the cylinder 211 is electrically connected to the swivel case 204 through wavy washers 233. The wavy washers 233 constitute a second electric connecting circuit which is joined to the swivel case 204 that serves as part of the first electric connecting circuit.

In the first and second embodiments, the wavy washers 21 or 233 are employed depending on the attitude of the cylinders 12, 211 as they are attached, and the cylinder 12 or 211 is electrically connected to the stern brackets 2 or the swivel case 204 by the employed wavy washers. Stated otherwise, the cylinders 12, 211 of the tilt cylinder devices 10, 210 can be installed in position with increased freedom.

Pin bearings for the pin by which the upper end 211*a* of the cylinder 211 is coupled to the swivel case 204 are spaced from each other by a distance L3, and pin bearings for the pin 208 are spaced from each other by a distance L4. These distances L3, L4 are the same as the distances L1, L2 (FIG. 2), respectively. Therefore, the hydraulic tilt cylinder device 10 according to the first embodiment is interchangeable with the hydropneumatic tilt cylinder device 210 according to the second embodiment of the present invention. As a result, the stern brackets 2, 202, and the swivel cases 4, 204 may be interchangeably used, and the number of types of parts required by the first and second embodiments may be reduced.

Since the distances L2, L4 are sufficiently small as shown, the mechanical strengths of the pins 12*e*, 203 and the stern brackets 2, 202 can easily be designed.

The corrosion-resistant mechanism 250 shown in FIG. 7 offers the same advantages as those of the corrosion-resistant mechanism 50 according to the first embodiment.

As shown in FIG. 8, a piston 213 integral with the piston rod 212 and a free piston 214 are successively fitted in the cylinder 211, with a gas chamber 215 defined above the free piston 214. The gas chamber 215 is filled with a compressive gas under a pressure is higher than the atmospheric pressure.

The piston 213 has a unidirectional valve 216 and a first pressure relief valve 217. The unidirectional valve 216 comprises a ball 216*b* and a relatively weak spring 216*a* for normally urging the ball 216*b* upwardly (FIG. 8), the spring 216*a* allowing the ball 216*b* to move downwardly due to the gravity of the outboard engine assembly 201. The first pressure relief valve 217 comprises a ball 217*b* and a relatively strong spring 217*a* for normally urging the ball 217*b* downwardly (FIG. 8), the spring 217*a* preventing the ball 217*b* from moving under normal propulsive forces produced by the outboard engine assembly 201 and allowing the ball 217*b* to move upwardly under excessive external forces applied when the boat is propelled forwardly. For the convenience of the description which follows, the space above the piston 213 and below the free piston 214 will be referred to as a first chamber C1, the space below the piston 213 as a second chamber C2, and the space above the free piston 214 and below the gas chamber 215 as a third chamber C3.

The cylinder 211 has a communication passage 218 through which the second and third chambers C2, C3 are held in communication with each other. The communication passage 218 has a second pressure relief valve 219 comprising a ball 219*b* and a relatively strong spring 219*a* for normally urging the ball 219*b* upwardly. The second pressure relief valve 219 can manually be opened and closed with a manual opening/closing mechanism M which comprises an eccentric cam 221 having a shaft 221*a* and a manual handle 222 fitted over the shaft 221*a*, for angularly moving the eccentric cam 221.

Operation of the tilt cylinder device 210 according to the second embodiment will be described below with reference to FIGS. 9A through 12B.

Figure 9A:
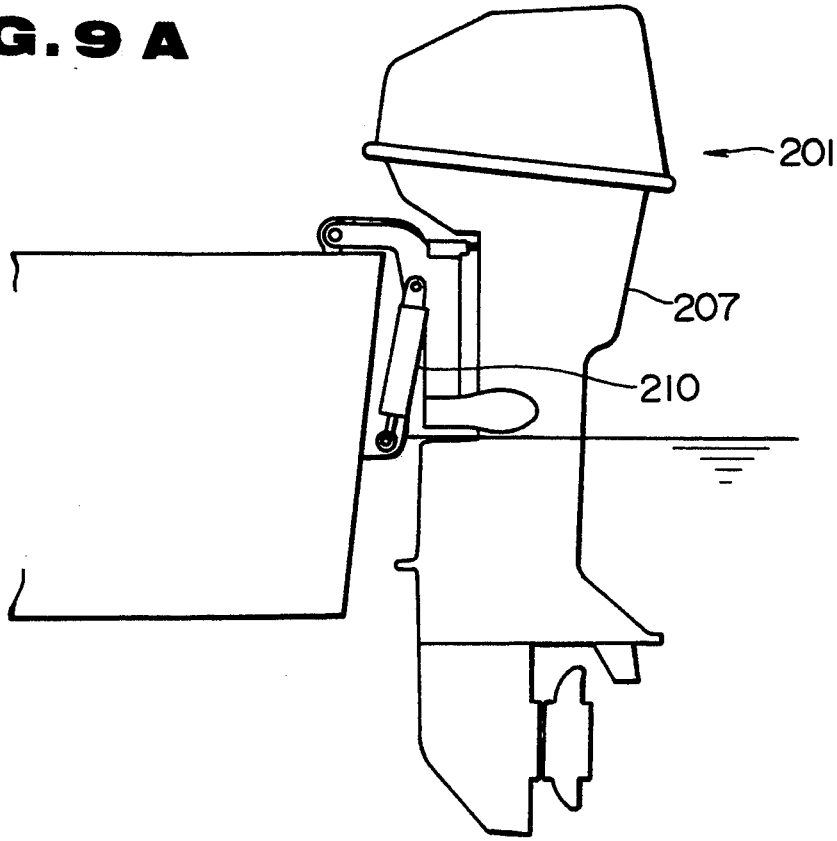
FIG. 9A is a schematic side elevational view of the outboard engine assembly according to the second embodiment, showing the boat as it sails forwardly.
Figure 9B:
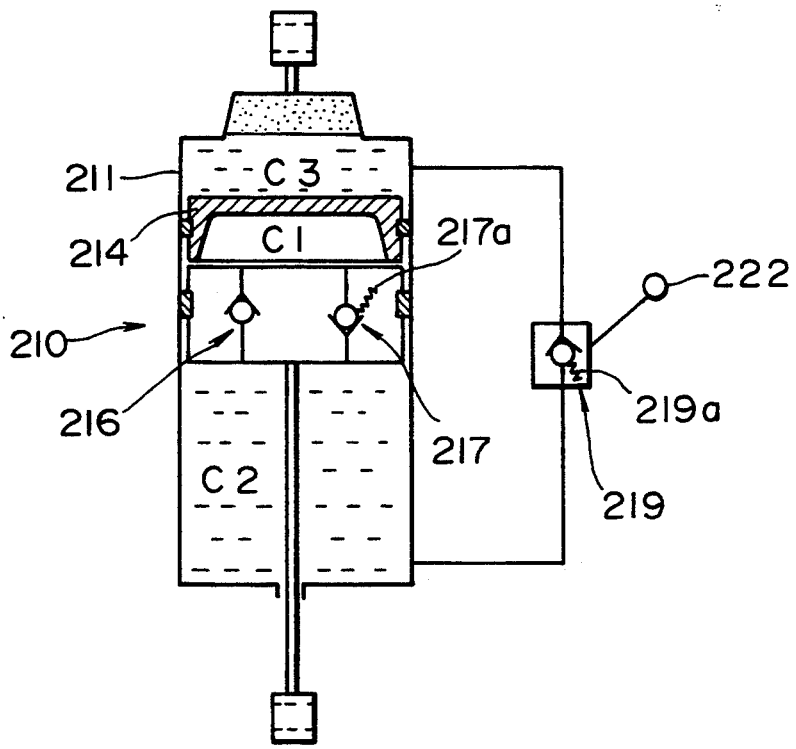
FIG. 9B is a diagram illustrative of how the tilt cylinder assembly shown in FIG. 7 functions.

FIG. 9A shows the outboard engine assembly 201 when the boat on which it is installed sails forwardly. When the boat sails forwardly, as shown in FIG. 9B, since the first and second pressure relief valves 217, 219 are closed, no working oil flows between the first chamber C1, the second chamber C2, and the third chamber C3.

Figure 10A:
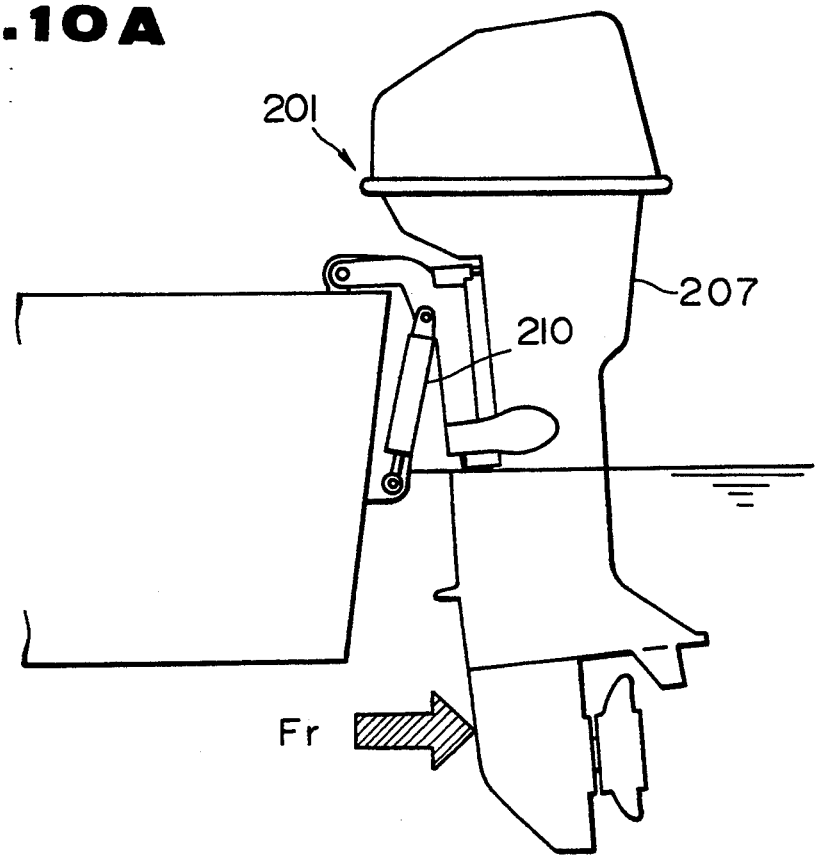
FIG. 10A is a schematic side elevational view of the outboard engine assembly shown in FIG. 9A as it is subjected to an external force applied in a rearward direction.
Figure 10B:
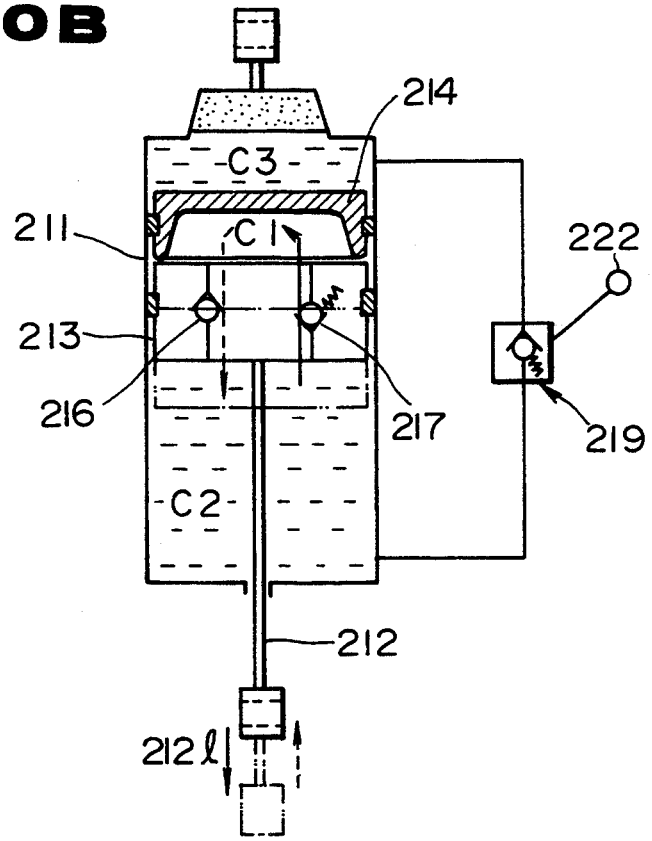
FIG. 10B is a diagram showing the manner in which the tilt cylinder device operates when the outboard engine assembly is subjected to the rearward external force as shown in FIG. 10A.

If an excessive external force Fr acts rearwardly on the outboard engine assembly 201 while the boat is sailing forwardly, as shown in FIG. 10A, the cylinder 211 moves upwardly, as shown FIG. 10B, allowing the piston rod 212 to be withdrawn relatively downwardly (as indicated by the arrow 212*l*) from the cylinder 211. As the pressure in the second chamber C2 unduly builds up, the working oil flows through the first pressure relief valve 217 into the first chamber C1, pushing the piston 213 downwardly.

Therefore, when the outboard engine assembly 201 is subjected to the large external force Fr, the outboard engine body 207 is quickly lifted to avoid unwanted damage.

Figure 11A:
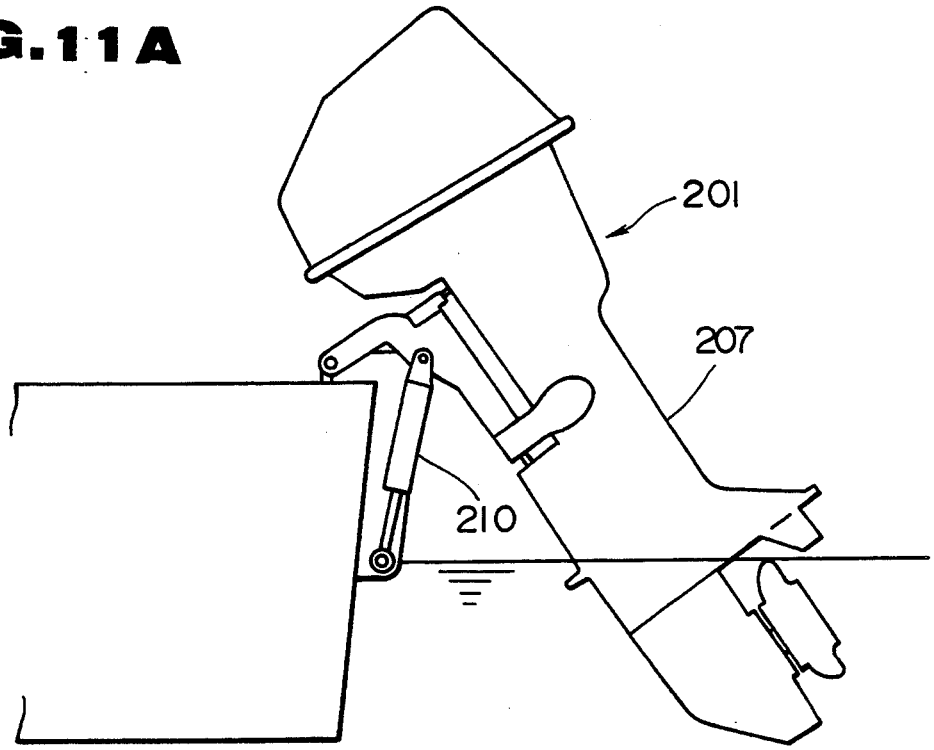
FIG. 11A is a schematic side elevational view of the outboard engine assembly shown in FIG. 9A as the boat sails backwards in the shallows.
Figure 11B:
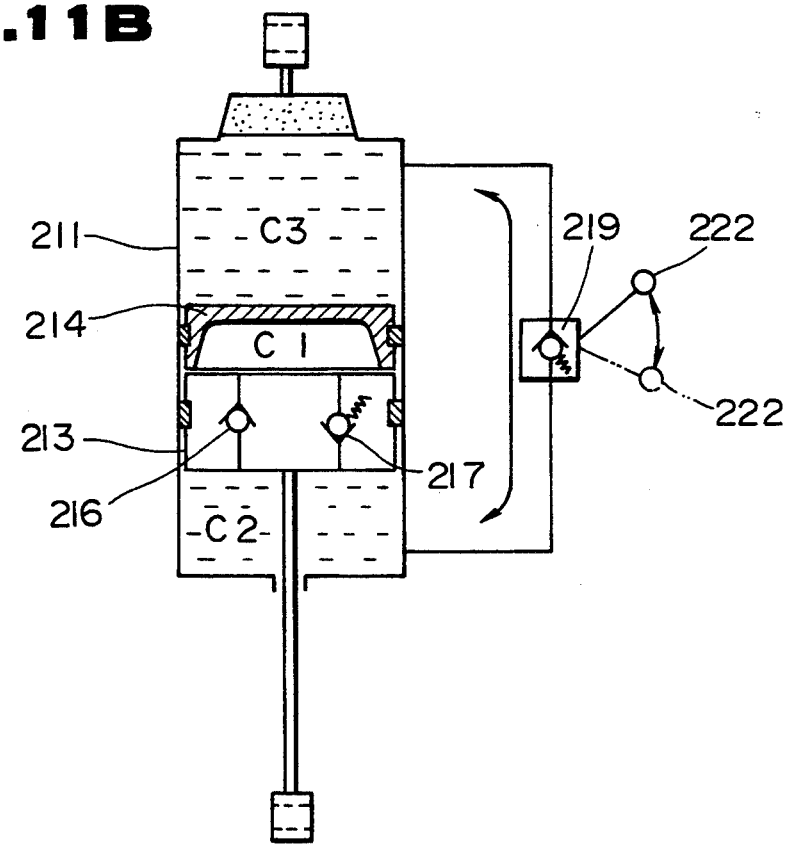
FIG. 11B is a diagram showing the manner in which the tilt cylinder device operates when the boat sails backwards in the shallows as shown in FIG. 11A.

FIG. 11A shows the outboard engine assembly 201 while the boat is sailing in the shallows. The handle 222 is turned to forcibly open the second pressure relief valve 219 to bring the second chamber C2 into communication with the third chamber C3, as shown in FIG. 11B. The outboard engine body 207 can now manually be elevated to the position shown in FIG. 11A. When the second pressure relief valve 219 is manually closed, the piston 213 is fixed in position, so that the outboard engine body 207 is held at a desired angle by the tilt cylinder device 210.

Figure 12A:
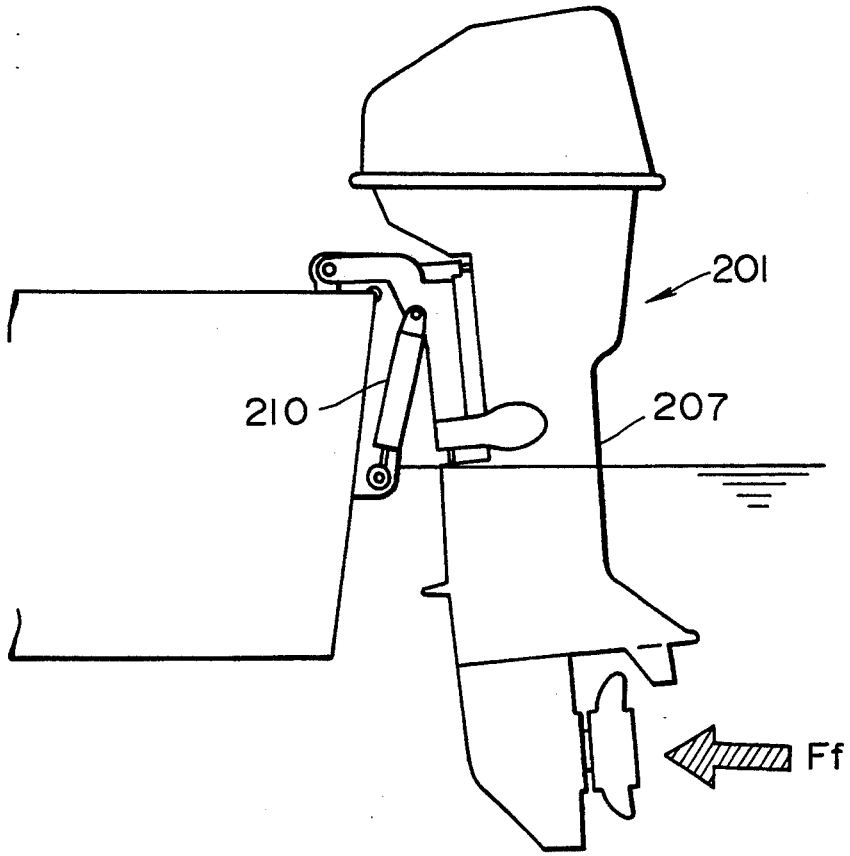
FIG. 12A is a schematic side elevational view of the outboard engine assembly as it is subjected to an external force applied in a forward direction while the boat is sailing backwards as shown in FIG. 11A.
Figure 12B:
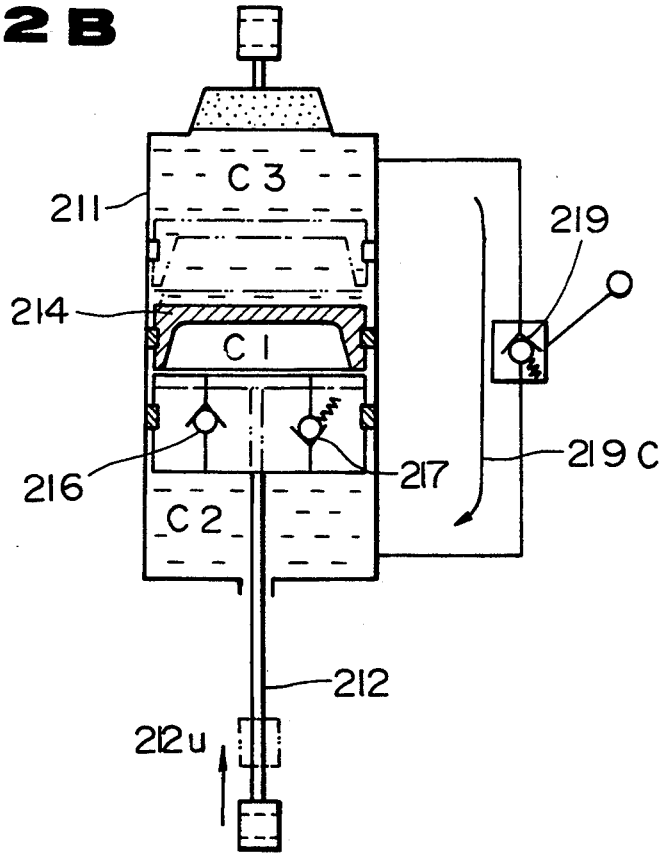
FIG. 12B is a diagram showing the manner in which the tilt cylinder device operates when the outboard engine assembly is subjected to the forward external force as shown in FIG. 12A.

FIG. 12A illustrates the outboard engine assembly 201 when the engine body 207 is subjected to a large forward external force Ff while the boat is moving backwards. Under the forward external force Ff applied, the piston rod 212 tends to move upwardly (as indicated by the arrow 212*u*) relatively to the cylinder 211, developing a pressure buildup in the third chamber C3. When the pressure in the third chamber C3 exceeds a certain level, the second pressure relief valve 219 is opened, allowing working oil to flow from the third chamber C3 into the second chamber C2 in the direction indicated by the arrow 219C. Therefore, the outboard engine body 207 is prevented from being damaged. The free piston 214, the first and second pressure relief valves 217, 219, the communication passage 218, and the first through third chambers C1, C2, C3 jointly serve as a mechanism for preventing the tilt cylinder device 210 from being damaged.

Figure 13:
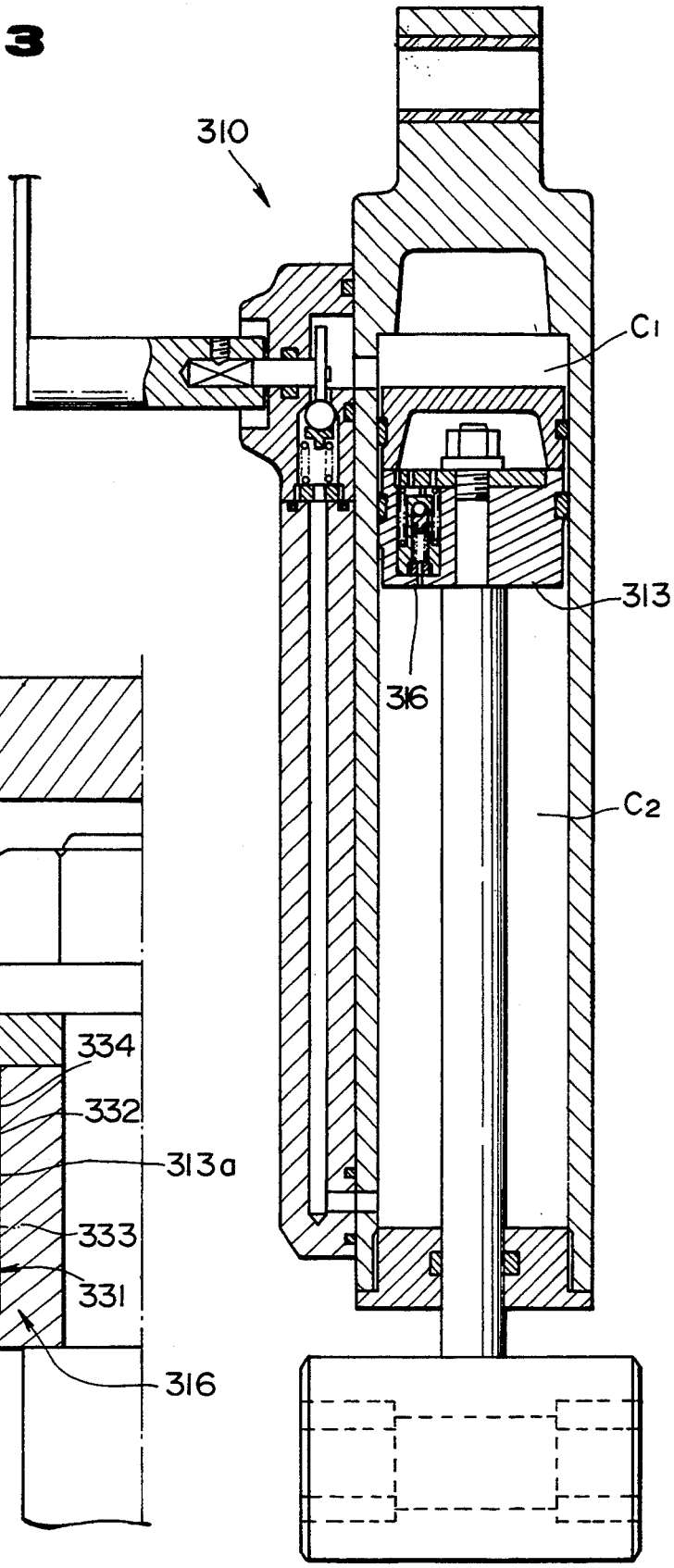
FIG. 13 is a cross-sectional view of a tilt cylinder device according to a modification of the second embodiment of the present invention.

FIG. 13 shows a tilt cylinder device 310 according to a modification of the tilt cylinder device 210 shown in FIG. 8. The tilt cylinder device 310 is essentially the same as the tilt cylinder device 210 except that it has a unitary valve assembly 316 which is a combination of the first and second pressure relief valves 217, 219 shown in FIG. 8. The other components shown in FIG. 13 are identical to the corresponding components shown in FIG. 8, with some of them denoted by identical reference numerals.

Figure 14:
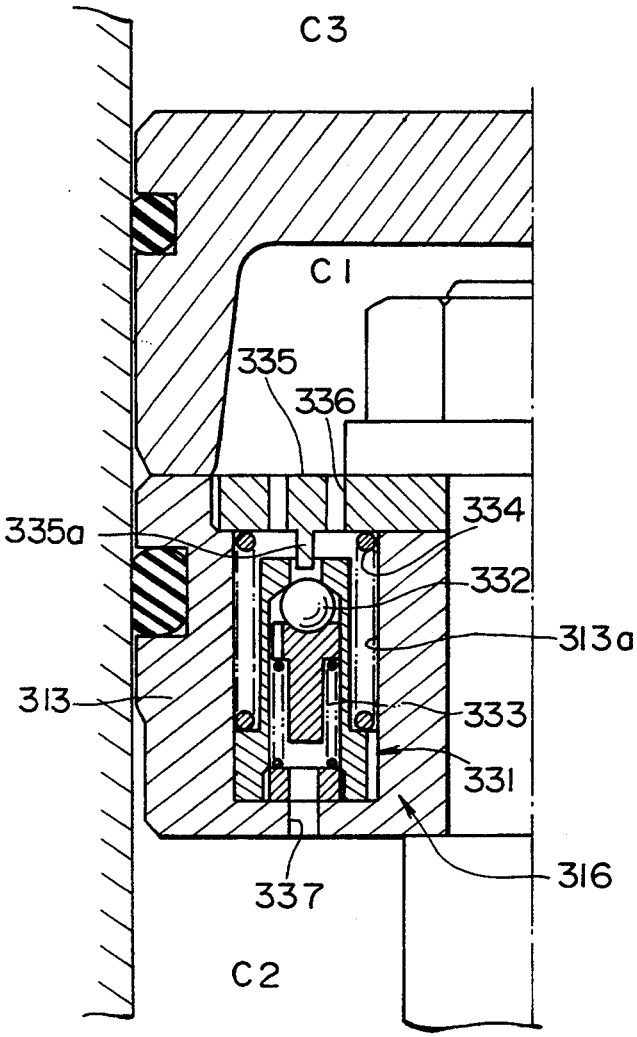
FIG. 14 is an enlarged fragmentary cross-sectional view of the tilt cylinder device shown in FIG. 13.
Figure 15:
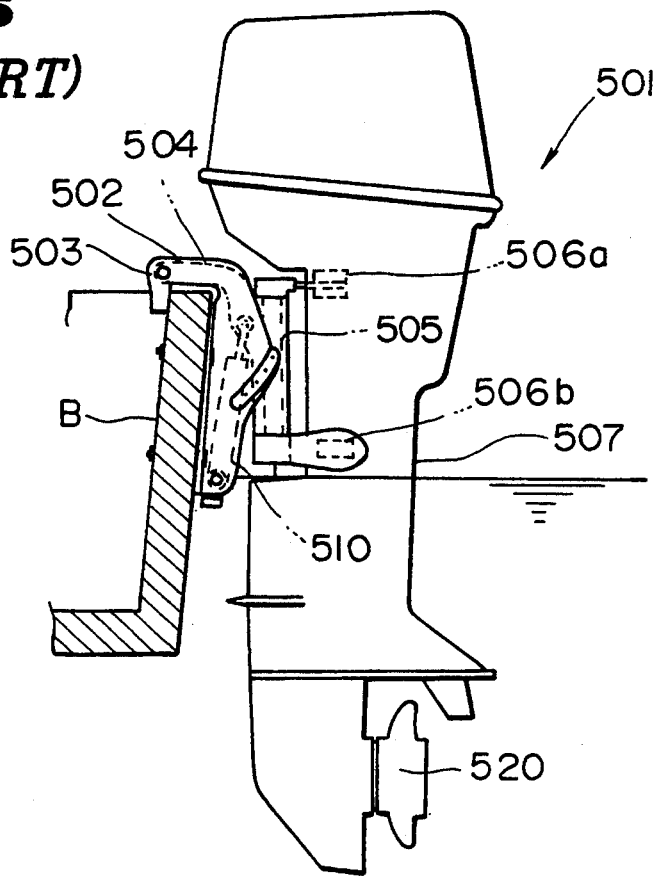
FIG.15 (PRIOR ART)
FIGS. 15 and 16 are schematic side elevational views of a conventional outboard engine assembly.

FIG. 14 shows at an enlarged scale the unitary valve assembly 316 shown in FIG. 13. The unitary valve assembly 316 includes a valve seat 331 vertically movably disposed in a cavity 313*a* defined in a piston 313, a ball 332, and a relatively weak spring 333 for normally urging the ball 332 upwardly, the spring 333 allowing the ball 332 to move downwardly due to the gravity of the outboard engine assembly. The unitary valve assembly 316 also includes a relatively strong spring 334 for normally urging the valve seat 331 downwardly. The spring 334 prevents the valve seat 331 from moving upwardly under normal propulsive forces from the outboard engine assembly, but allows the valve seat 331 to move upwardly under an excessive external force, such as the force Fr in FIG. 10A, applied while the boat is sailing forwardly. A retainer 335 is positioned above the ball 332 and has a limit pin 335*a* projecting downwardly toward the ball 332.

When an external force, such as the force Fr in FIG. 10, is applied to develop an undue pressure buildup in the second chamber C2, the valve seat 331 moves upwardly under the developed pressure buildup, but the ball 332 is prevented from moving upwardly by the limit pin 335*a*. Since the ball 332 is unseated, working oil is now permitted to flow from the second chamber C2 into the first chamber C1.

When the weight of the outboard engine assembly is applied, the working oil in the first chamber C1 flows downwardly through upper passages 336, depressing the ball 332. The working oil then flows through a lower passage 337 into the second chamber C2.

As shown in FIG. 14, the valve components in the single cavity 313*a* serve to limit flow of working oil in two directions. The single cavity can easily be defined in a piston of a relatively small diameter with a greater degree of design freedom than a corresponding pair of cavities which could be utilized to permit the flow of working oil in two directions, respectively. The tilt cylinder device 310 shown in FIGS. 13 and 14 is also effective to prevent the outboard engine assembly from being damaged when external forces are applied thereto.

According to the embodiment and modification shown in FIGS. 7 through 14, the outboard engine body is prevented from being damaged under external forces due to collision, for example while the boat is sailing forwardly, or rearwardly in the shallows, so that the outboard engine assembly can have a long service life. The outboard engine assembly can easily be handled because the angle of inclination of the outboard engine assembly can freely be varied by operating the second pressure relief valve 219 with the manual handle 222.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A tilt device in a boat propelling apparatus having a pair of stern brackets adapted to be fixed to a boat body, a swivel case vertically swingably supported on the stern brackets by a tilt shaft, said swivel case being adapted to have a propulsion unit mounted thereon, said tilt device being disposed between the swivel case and the stern brackets, said tilt device comprising:

a pressurized fluid supply for supplying a pressurized fluid;

a cylinder unit actuatable by the pressurized fluid supplied from said pressurized fluid supply;

said pressurized fluid supply and said cylinder unit being disposed within an outer profile established by said pair of stern brackets;

said cylinder unit including a cylinder case which is relatively angularly movably coupled at a lower end thereof to said stern brackets, and a piston rod which is expandable from the cylinder case and is relatively angularly movably coupled at an upper end thereof to said swivel case;

said pressurized fluid supply including an assembly of a pump and a motor, said assembly being coupled with the cylinder case and being positioned lower than the upper end of the piston rod in a fully contracted state thereof;

said pump and motor assembly being disposed on one side of said cylinder unit, and said pressurized fluid supply further including a reservoir disposed on the other side of said cylinder unit, said reservoir being formed on an upper portion of said cylinder unit, and said pump and said motor assembly being coupled to a lower portion of said cylinder unit; and said swivel case including support members coupled to the upper end of said piston rod and extending laterally above said pump and motor assembly on the one side of said cylinder unit and above the reservoir on the other side of said cylinder unit.

2. A tilt device according to claim 1, wherein said cylinder unit is disposed substantially centrally in a planar region defined by said swivel case.

3. A tilt device according to claim 2, wherein said reservoir is integrally formed with said cylinder case and positioned lower than the upper end of said piston rod.

4. A tilt device according to claim 1, wherein:

said pressurized fluid supply includes a pump case for said pump, said cylinder unit includes a hydraulic manual relief valve mounted on said pump case, and one of said stern brackets has a window defined therein for manually operating said manual relief valve therethrough.

5. A tilt device according to claim 4, wherein said window is opened over a range adapted to avoid physical interference with said pump case.

6. An outboard engine assembly comprising:

a stern bracket adapted to be fixed to a boat body;

a swivel case;

an engine body laterally swingably supported on the swivel case;

a tilt cylinder device disposed between the stern bracket and the swivel case;

said tilt cylinder device comprising a hydraulic cylinder disposed substantially centrally of said stern bracket in a transverse direction of the boat body, said hydraulic cylinder having a vertically extending cylinder case, a motor and a pump which are disposed on one side of said hydraulic cylinder, and a reservoir disposed on the other side of said hydraulic cylinder;

said motor, said pump, and said reservoir being positioned lower than an upper surface of said cylinder case and housed in said stern bracket; and said pump having a pump case, said tilt cylinder device also including a hydraulic manual relief valve mounted on said pump case, said stern bracket having a window for manually operating said manual relief valve therethrough.

7. An outboard engine assembly according to claim 6, wherein:

said swivel case is vertically swingably supported on said stern bracket by a tilt shaft, and said tilt cylinder device lies substantially perpendicular to said tilt shaft.

8. An outboard engine assembly according to claim 6, wherein:

said reservoir is coupled to an upper portion of said tilt cylinder device, and said pump and said motor are coupled to a lower portion of said tilt cylinder device.

9. An outboard engine assembly according to claim 6, wherein:

a lower portion of said stern bracket has a slot defined therein, said slot is adapted for fixing said stern bracket to the boat body, and said window is positioned at substantially the same level as said slot.

10. An outboard engine assembly according to claim 9, wherein:

said stern bracket includes a vertically extending wall, a lower portion of said vertically extending wall is bent inwardly of said stern bracket toward said manual relief valve, and said window is defined in said lower portion of the wall.

11. An outboard engine assembly according to claim 10, wherein:

said window is adapted to avoid physical interference with said pump case.

12. An outboard engine assembly comprising:

a stern bracket adapted to be fixed to a boat body;

a swivel case;

an engine body laterally swingably supported on the swivel case;

a tilt cylinder device disposed between the stern bracket and the swivel case;

said tilt device comprising a hydraulic cylinder having a vertically extending cylinder case, a motor and a pump which are disposed on one side of said hydraulic cylinder;

said motor and said pump being coupled to with said cylinder case, positioned lower than an upper surface of said cylinder case and housed in said stern bracket; and said pump having a pump case, said tilt cylinder device also including a hydraulic manual relief valve mounted on said pump case, said stern bracket having a window for manually operating said manual relief valve therethrough, said window being defined and opened over a range covering all positions of the manual relief valve displaced with tilting of said tilt cylinder device.

13. A outboard engine assembly according to claim 12, wherein:

said tilt cylinder device further comprises a reservoir, said cylinder case being disposed substantially centrally in a planar region defined by said swivel case, said pump and said motor being disposed on one side of said cylinder case and coupled to a lower portion of said cylinder case, said reservoir being disposed on the other side of said cylinder case and coupled to an upper portion of said cylinder case, and said window being sufficiently opened to avoid physical interference with said pump case.

14. An outboard engine assembly according to claim 12, wherein:

said stern bracket includes a lower portion having a slot defined therein, said slot is adapted for fixing said stern bracket to the boat body, and said window is positioned at substantially a same level as said slot; and said stern bracket further includes a vertically extending wall, a lower portion of said vertically extending wall is bent inwardly of said stern bracket toward said manual relief valve, and said window is defined in said lower portion of the wall.

* * * * *

UNITED STATES PATENT AND TRADEMARK OFFICE

CERTIFICATE OF CORRECTION

PATENT NO. : 5,358,436
DATED : October 25, 1994
INVENTOR(S) : Soda et al.

It is certified that error appears in the above-indentified patent and that said Letters Patent is hereby corrected as shown below:

Column 2, line 9, change "out-board" to -- outboard --.

Column 14, line 14 (claim 12, line 12), delete "with".

Signed and Sealed this

Twentieth Day of December, 1994

*Attest:*

Bruce Lehman

BRUCE LEHMAN

*Attesting Officer*

*Commissioner of Patents and Trademarks*